US010779071B2

(12) United States Patent
Wu

(10) Patent No.: US 10,779,071 B2
(45) Date of Patent: Sep. 15, 2020

(54) HEADPHONE

(71) Applicant: AVerMedia Technologies, Inc., New Taipei (TW)

(72) Inventor: Cheng-Yun Wu, New Taipei (TW)

(73) Assignee: AVERMEDIA TECHNOLOGIES, INC., New Taipei (TW)

( * ) Notice: Subject to any disclaimer, the term of this patent is extended or adjusted under 35 U.S.C. 154(b) by 0 days.

(21) Appl. No.: 16/351,803

(22) Filed: Mar. 13, 2019

(65) Prior Publication Data

US 2019/0289379 A1 Sep. 19, 2019

(30) Foreign Application Priority Data

Mar. 15, 2018 (TW) ..... 107108774 A

(51) Int. Cl.
*H04R 1/10* (2006.01)
*H04R 1/02* (2006.01)

(52) U.S. Cl.
CPC ..... *H04R 1/1008* (2013.01); *H04R 1/028* (2013.01); *H04R 1/105* (2013.01)

(58) Field of Classification Search
CPC ..... H04R 1/1008; H04R 1/028; H04R 1/105
See application file for complete search history.

(56) References Cited

U.S. PATENT DOCUMENTS 4,969,069 A * 11/1990 Eichost ..... F21V 21/084 362/105
5,862,241 A * 1/1999 Nelson ..... H04R 1/105 381/374
6,629,579 B1 * 10/2003 Hasegawa ..... H04R 1/1066 181/129
6,724,906 B2 * 4/2004 Naksen ..... H04R 1/1066 381/370
7,114,823 B2 * 10/2006 McCullough ..... F21V 33/0056 362/105
7,171,698 B2 * 2/2007 Saffran ..... A61F 11/14 2/209
7,377,666 B1 * 5/2008 Tyler ..... A61F 11/14 362/105
8,075,153 B2 * 12/2011 Werner ..... A61F 11/14 128/866
8,818,011 B2 * 8/2014 Chen ..... H04R 1/1083 381/370
10,344,963 B1 * 7/2019 Mobed ..... F21V 33/0056
2012/0140973 A1 * 6/2012 Olodort ..... H04R 1/1066 381/375

(Continued)

*Primary Examiner* — Oyesola C Ojo
(74) *Attorney, Agent, or Firm* — McClure, Qualey & Rodack, LLP

(57) ABSTRACT

A headphone, which adjusts its decorative light by rotation, includes a headgear, earmuffs, light-emitting components and light covers. Each earmuff includes a translucent housing or a transparent housing. The light-emitting components are located in the earmuff, corresponds to the translucent housing. Light covers cover the earmuffs. First connecting members of the light covers are pivotally connected to the headgear so that the light covers can be easily rotated and the earmuffs can be adjusted to suit the user's head. The rotation of the light covers, which is relative to the translucent housing, changes the light-transmitting area of the translucent housings, so the headphone provides a variety of light effects and gorgeous visual experience.

10 Claims, 7 Drawing Sheets

(56) References Cited

U.S. PATENT DOCUMENTS

| | | | | |
|---|---|---|---|---|
| 2014/0259287 | A1* | 9/2014 | Waters | A41D 13/0002 2/209 |
| 2015/0222980 | A1* | 8/2015 | Pizzaro | H04R 1/1058 381/371 |
| 2016/0127819 | A1* | 5/2016 | Shiomi | H04R 1/1033 381/378 |
| 2016/0198255 | A1* | 7/2016 | Camello | H04R 1/1025 381/74 |
| 2017/0019724 | A1* | 1/2017 | Cochran | H04R 1/1066 |

* cited by examiner

HEADPHONE

CROSS REFERENCE TO RELATED APPLICATIONS

This Non-provisional application claims priority under 35 U.S.C. § 119(a) on Patent Application No. 107108774 filed in Republic of China on Mar. 15, 2018, the entire contents of which are hereby incorporated by reference.

BACKGROUND

1. Technical Field

The present invention generally relates to a dissipation device, and more particularly, to a dissipation device based on a heat radiation mechanism.

2. Description of Related Art

Earphone is a conversion unit that typically has one or two speakers to receive the electrical signals from a media player or receiver and convert it into audible sound waves by using a speaker that is close to the ear. The headphone is usually detachable from the media player and is connected by a plug. With the popularity of consumer electronics devices, headphone has been widely used in devices such as video games, mobile phones, webcast interactions, computers and digital audio players.

However, the conventional earphone structure has the disadvantages such as monotonous appearance. With the improvement of aesthetic qualities, users pay increasing attention to the shape and color of the headphones when choosing headphones. As the earphones are used for the purpose of playing, there are also users who use the earphones as wearing accessories. However, the shape and color of the earphones cannot be changed, resulting in excessive consumption of the plurality of sets of earphones.

Furthermore, the earphone does not provide the visual reminder function. The earphone uses the audio cable as the medium for connecting the player and the speaker. It can only use the sound of the speaker to inform the user, with limited reminder effect. In addition, the degree of freedom of the earphone structure is limited, and it is difficult for the users to adjust the position of the earphone according to their own habits.

Therefore, how to provide a headphone to improve the above-mentioned shortcomings is one of the current important issues.

Given the above, it may be therefore desirable to have an improved heat dissipation device based on heat-radiation mechanism, which can address the above-identified technical problem and thus enhance efficiency of heat dissipation.

SUMMARY OF THE INVENTION

It is therefore an object of the present invention to provide a headphone, wherein a joint of the earmuff cover and the light cover show a variety of light source effects from different clamping angles.

To achieve the above, the present invention is to provide a headphone including a headgear, an earmuff, a set of light-emitting components and a light cover. Each earmuff includes a translucent housing or a transparent housing. The light-emitting components are located in the earmuff corresponding to the translucent housing. The light cover is movably covered outside the earmuff. The light cover includes a first connecting member and a second connecting member. The first connecting member is pivotally connected to the headgear, and the second connecting member is pivotally connected to the earmuff.

In one embodiment of the present invention, the headgear includes a first insertion pin, and the first connecting member of the light cover is a first hole, and the first insertion pin is inserted into the first hole to pivot the light cover with the headgear. The second connecting member of the light cover is a second insertion pin, and the earmuff includes a second hole, and the second insertion pin is inserted into the second hole to pivot the light cover to the earmuff. In addition, the second hole may be disposed on the translucent housing of the earmuff.

In one embodiment of the present invention, the light cover and the translucent housing form a first light-transmitting window. The rotation of the light cover relative to the translucent housing can change the area of the first light-transmitting window. Moreover, in one embodiment of the invention, the light cover and the translucent housing further consists a second light-transmitting window. The first light-transmitting window and the second light-transmitting window are located on opposite sides of the light cover, and the rotation of the light cover relative to the translucent housing causes a negative correlation change between the area of the first light-transmitting window and the second light-transmitting window.

In one embodiment of the present invention, the light cover may further comprise a semi-circular lateral plate, an arc side strip and a bridge part. The arc side stripe extends from the circumference of the semi-circular lateral plates. The bridge part extends from the arc side strip and includes a first connecting member of the light cover that is pivotally connected to the headgear. In addition, the shape of the translucent housing essentially corresponds to the shape of the semi-circular lateral plates and the arc side strips of the light cover.

In one embodiment of the present invention, the second connecting member of the light cover is located at one end of the arc side strip and is located inside the light cover.

In one embodiment of the present invention, the headphone further includes a control board in the earmuff for adjusting the light color, blinking rate, and/or lightness of the light-emitting components.

In summary, the present invention can easily rotate the angle of the light cover and adjust the earmuff to accommodate the head shape of user. The rotation of the light cover changes the area of the light-transmitting window of the translucent housing. The connection between the earmuffs and the light cover will provide a variety of light effects according to the clamping angle, providing varied and gorgeous visual experience while conveying visual information to people other than the wearer.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

The parts in the drawings are not necessarily drawn to scale, the emphasis instead being placed upon clearly illustrating the principles of at least one embodiment. In the drawings, like reference numerals designate corresponding parts throughout the various diagrams, and all the diagrams are schematic.

DETAILED DESCRIPTION

Reference will now be made to the drawings to describe various inventive embodiments of the present disclosure in detail, wherein like numerals refer to like elements throughout.

Figure 1:
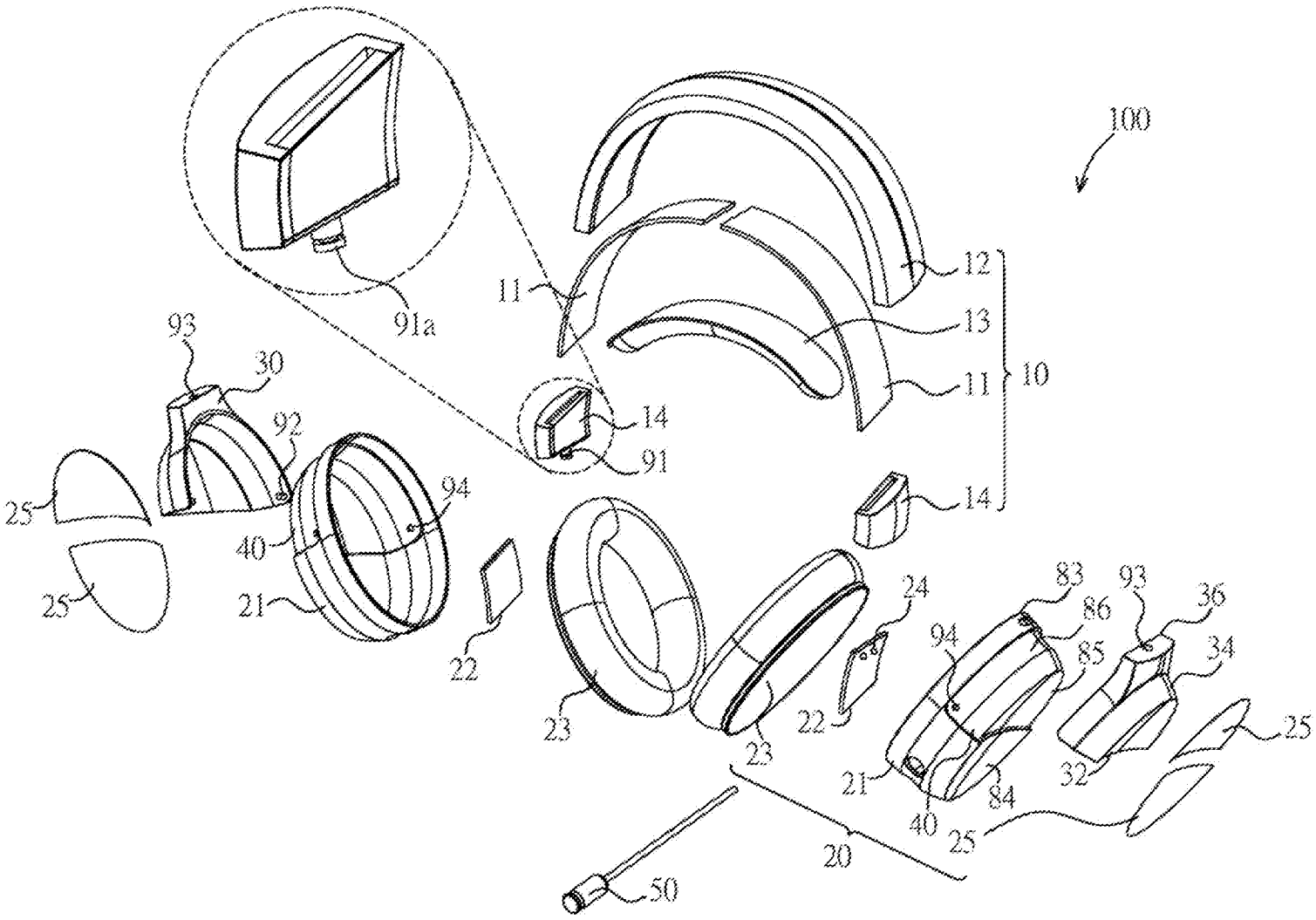
FIG. 1 is a schematic exploded view showing a headphone according to an embodiment of the invention.

Please refer to FIGS. 1 to 5, including a schematic exploded view, a schematic external view, a side view, a front view and a top view of a headphone 100 respectively, according to the preferred embodiment of the invention. As shown in FIGS. 1 to 5, the headphone 100 includes an arc headgear 10, two earmuffs 20 covering the ears of users, a plurality of light-emitting components 24 in the earmuffs 20 (as shown in FIG. 1), and two light covers 30 between the earmuffs 20 and the headgear 10, two control boards 22 (as shown in FIG. 1) and one microphone 50.

As shown in FIG. 1, the headgear 10 includes two arc frames 11, an outer housing 12, a cushion 13 and two headgear connecting members 14. The outer housing 12 and the cushion 13 are respectively located on the upper and lower sides of the arc frame 11 for providing a comfortable wearing experience o and a shape color of the headphone 100. The two headgear connecting members 14 are symmetrically disposed at both ends of the arc frame 11. Among them, the headgear connecting member 14 has a first insertion pin 91 for pivotally connecting the light cover 30. The arc frame 11 is generally made of metal material and has elasticity, enabling the users to use the headphone 100 according to a position where they feel comfortable, but is not limited to this.

Each of the earmuffs 20 includes a main housing 21, a translucent housing 40 set on the upper part of the earmuffs 20, a gasket 23, a decorative piece 25 and a speaker (not shown in figure).

Each main housing 21 includes a circular strip (or so-called O-ring) 83 and a semi-circular lateral plate 84. The semi-circular lateral plate 84 extends inwardly from the semi-circular inner edge of the circular strip 83 to protect the internal components, such as waterproof. The decorative piece 25 can be attached or assembled to the outer surface of each of the main housings 21, whereby the effect of the decoration of the earmuffs 20 is achieved. In other embodiments, the main housing 21 may also include other shapes of side strips and lateral plates, such as ellipse, square, rectangular, hexagonal, star-shaped, other polygonal or any shape.

The translucent housing 40 includes a semi-circular lateral plate 85 and an arc side strip 86 extending from the circumference of the semi-circular lateral plate 32. The translucent housing 40 may be made of a translucent or semi-translucent material such as plastic. The translucent housing 40 may include a pattern or a microstructure, such as a bump microstructure that allows uniform diffusion of light, but is not limited to this. The translucent housing 40 can be fitted to the main housing 21. The assembly of the main housing 21, the translucent housing 40 and the washer 23 can define an installation space and provide mounting arrangements for the speaker, the lighting assembly 24 and the control board 22. A second hole 94 is defined in the arc side strip 86 of each of the translucent housings 40 for pivoting the earmuffs 20 to the light cover 30.

The light-emitting components 24 are disposed in the earmuffs 20, corresponding to the translucent housing 40, so that the light of the light-emitting components 24 can be outwardly presented through the translucent housing 40. The light-emitting components 24 are electrically connected to the control board 22, for example, the light-emitting components 24 can be directly disposed on the control board 22.

The control board 22 is disposed in the earmuffs 20. The chip of the control board 22 provides a change of the light effect, and the auxiliary software can customize the light color, the blinking rate, the brightness and the other color developing functions of the light-emitting components 24. For example, the control board 22 can electrically connect the light-emitting components 24, the speaker and the sound source device by using a circuit, and control the ON and OFF with the power module. Also, it can control the volume of the speaker, the play, pause, and the music selection function of the sound source device, and the light source indication function of the light-emitting components 24. The control board 22 can select the signal of the sound source device and the light control device by the wireless receiving unit of the Bluetooth technology. It can also receive the signal of the sound source device and the light control device by using the signal line.

The light cover 30 covers the outside of the earmuffs 20. The light cover 30 includes a semi-circular side plate 32, an arc side strip 34, a bridging connection 36, a decorative piece 25, a first hole 93 and a second insertion pin 92. The shape of the semi-circular side plate 32 and the arc side strip 34 of the light cover 30 substantially corresponds to the shape of the semi-circular side plate 85 of the translucent housing 40 and an arc side strip 86. The arc side strip 34 extends from the circumference of the semi-circular lateral plates 32, and the bridging connection 36 extends from the arc side strip 34.

The first hole 93 is located above the bridge part connection 36 as the first connecting member of the light cover 30. The first insertion pin 91 with a terminated protrusion 91*a* of each of the headgear connection_14 is inserted into the first hole 93, so that the light cover 30 is rotatably pivotally connected to the headgear 10.

The second insertion pin 92 is located at one end of the arc side strip 34 and is inside the light cover 30 as a second connecting member of the light cover 30. The second insertion pin 92 of the light cover 30 is inserted into the second hole 94 of the earmuff 20, so that the light cover 30 is pivotally connected to the earmuffs 20. Since one end of the light cover 30 is connected to the headgear 10, and the other end of the light cover 30 is connected to the earmuffs 20, the light cover 30 and the earmuffs 20 can be easily rotated at various angles, and the washer 23 of the earmuffs 20 is adjusted to suit different head sizes. Since the two earmuffs 20 are first pivotally connected to the light cover 30 and then through the light cover 30 to pivot the headgear 10, the headphone 100 of the invention can provide two different adjustment positions and two different directions of angular plane rotations, the users to use the headphone according to the position where they comfortable.

The connection design, the rotatable angle and the static friction force of the light cover 30 of the invention and the headphone 10 and the earmuffs 20 can be adjusted according to actual needs. For example, the first insertion pin 91, the first hole 93, the second insertion pin 92 and the second hole 94 of the headphone 100 can be replaced with a rotatable clamping member, a gear clamping member, a ball fitting member or a magnetic piece. When the static friction is small, the light cover 30 and the earmuffs 20 are easily adjusted according to the user's head shape; when the static friction is large, the light cover 30 and the ear cover 20 are easily maintained in a state of manual adjustment by the user. The angle of rotation of the light cover 30 with the headphone 10 and the earmuffs 20 can be in multi-segment or continuous design.

Figure 6:
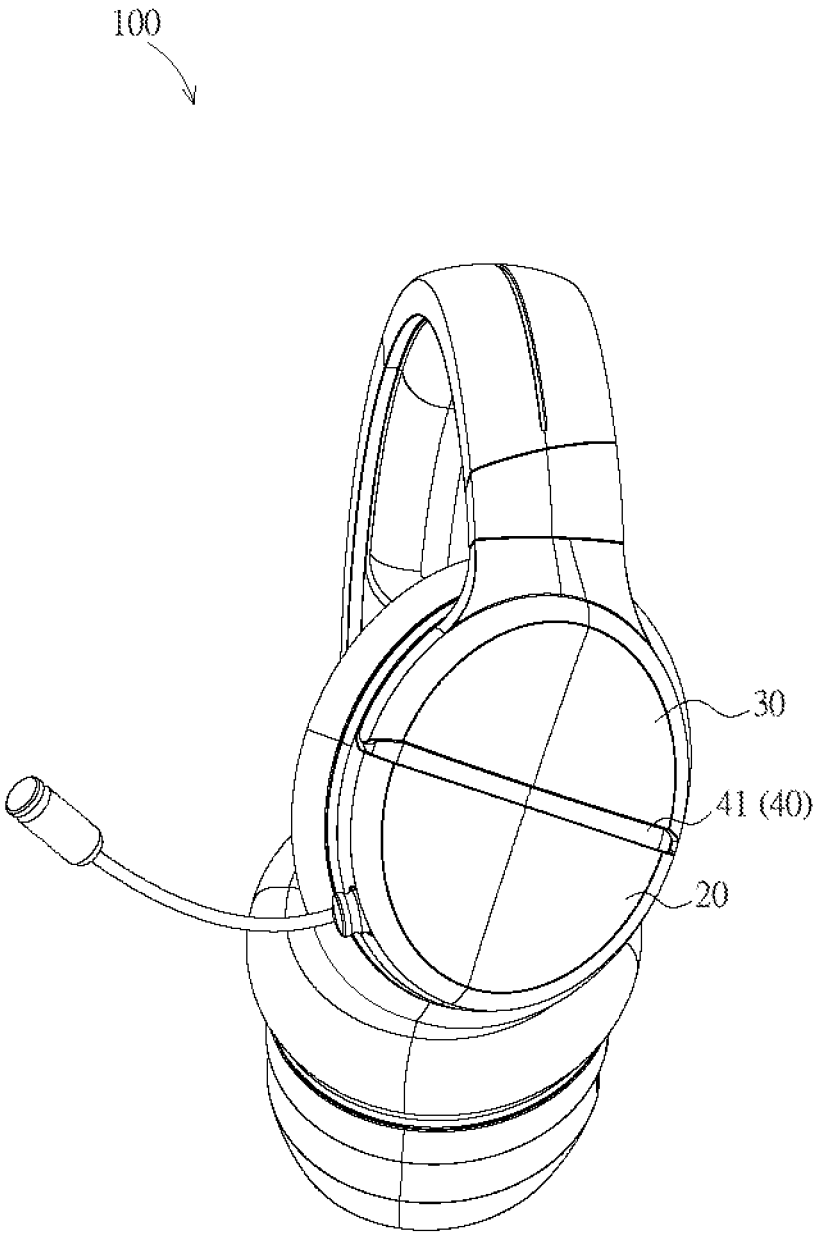
FIG. 6 is a schematic operational diagram showing the headphone according to the embodiment of the invention.
Figure 7:
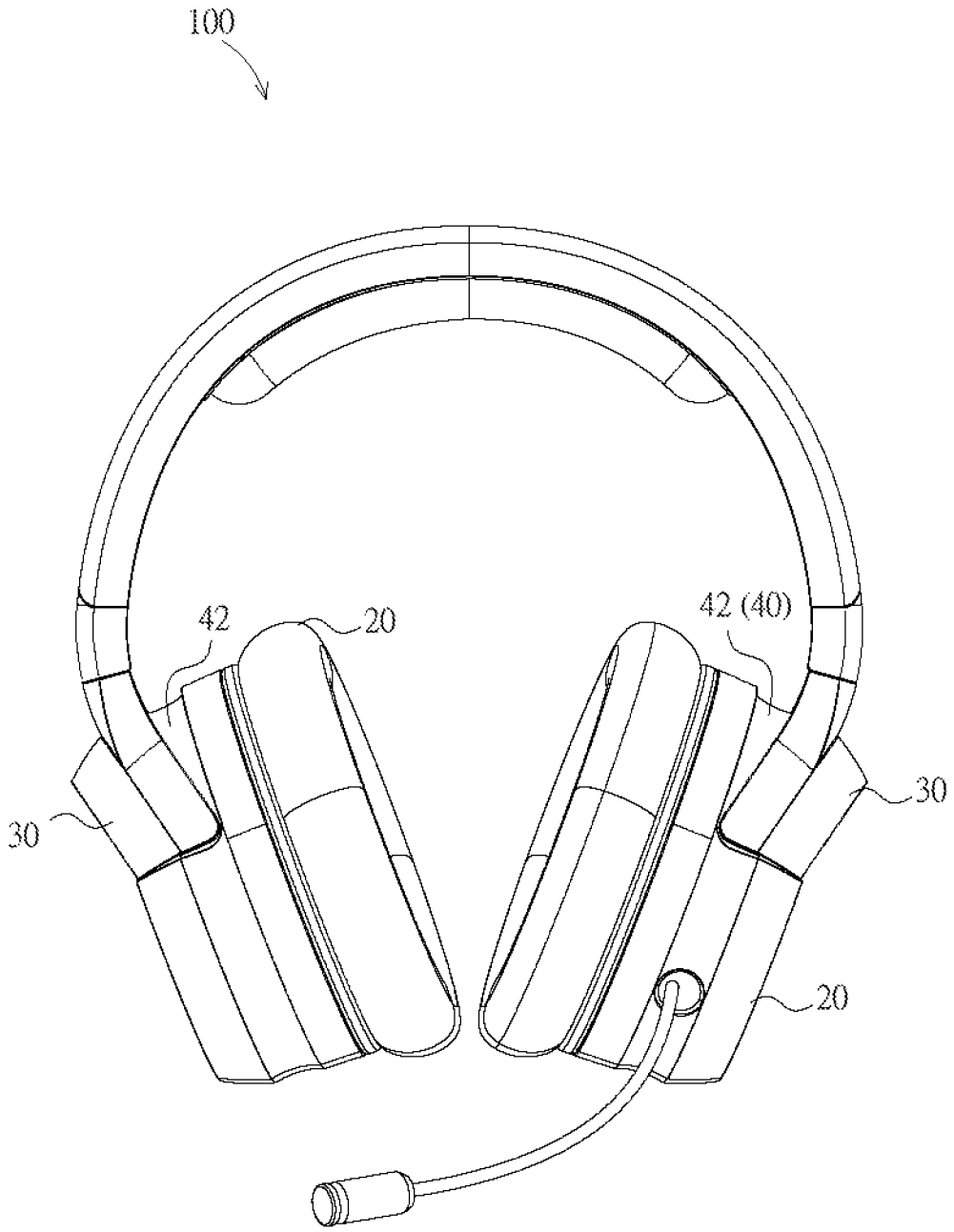
FIG. 7 is another schematic operational diagram showing the headphone according to the embodiment of the invention.

Please refer to FIG. 6 and FIG. 7, which are schematic diagrams showing the upper rotation operation and the lower rotation operation of the light cover 30 of the headphone 100 according to the preferred embodiment of the invention. As shown in FIG. 6, please compare with FIG. 2, and the light cover 30 of FIG. 6 is rotated upward relative to the earmuffs 20. The light cover 30 and the translucent housing 40 form a first light-transmitting window 41 exposed to the lower portion of the translucent housing 40, and the rotation of the light cover 30 relative to the translucent housing 40 changes the area and shape of the first light-transmitting window 41. The larger the angle at which the light cover 30 is rotated upward compared with the earmuffs 20, the larger the area and the higher the shape height of the first light-transmitting window 41 is.

Figure 3:
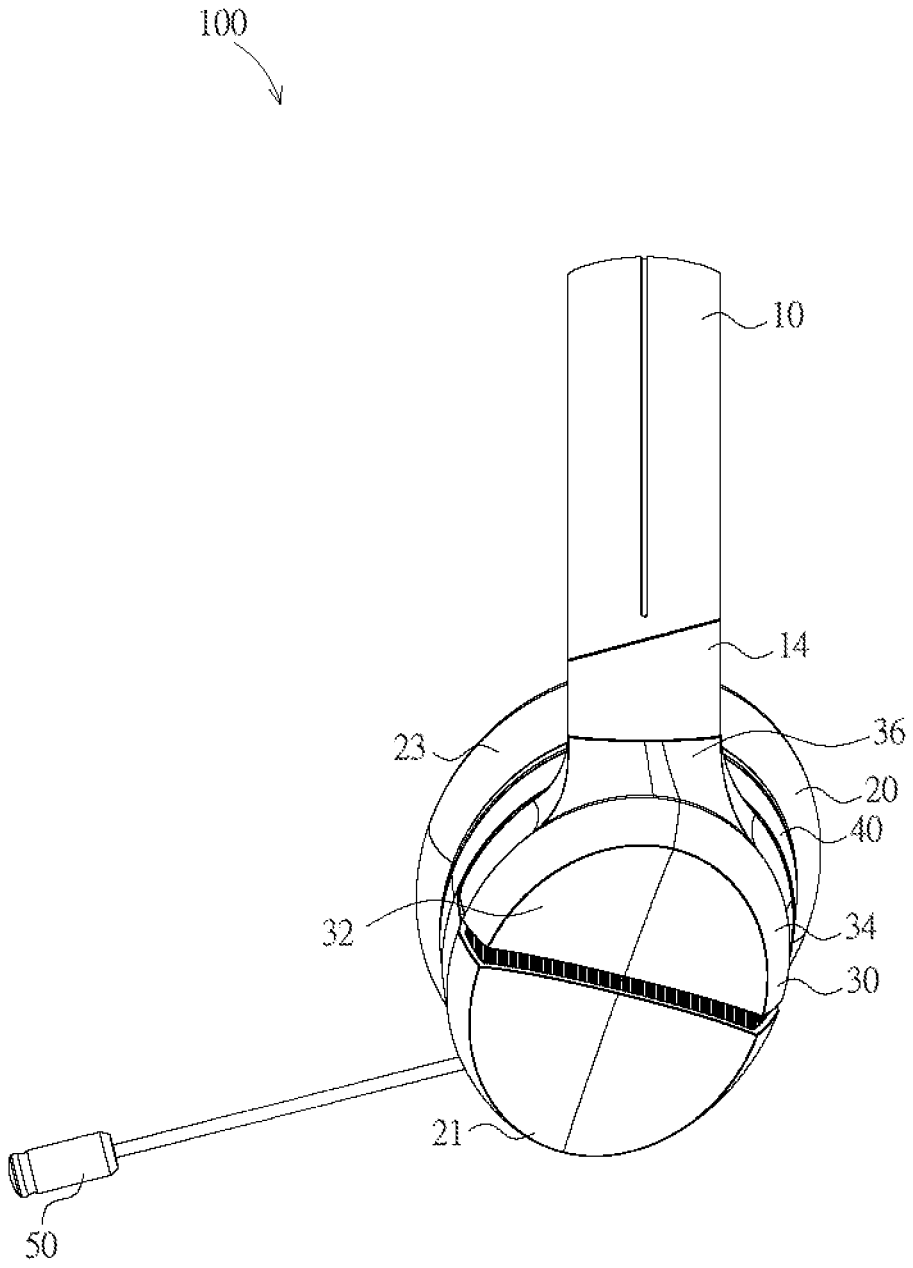
FIG. 3 is a schematic side view showing the headphone according to the embodiment of the invention.
Figure 4:
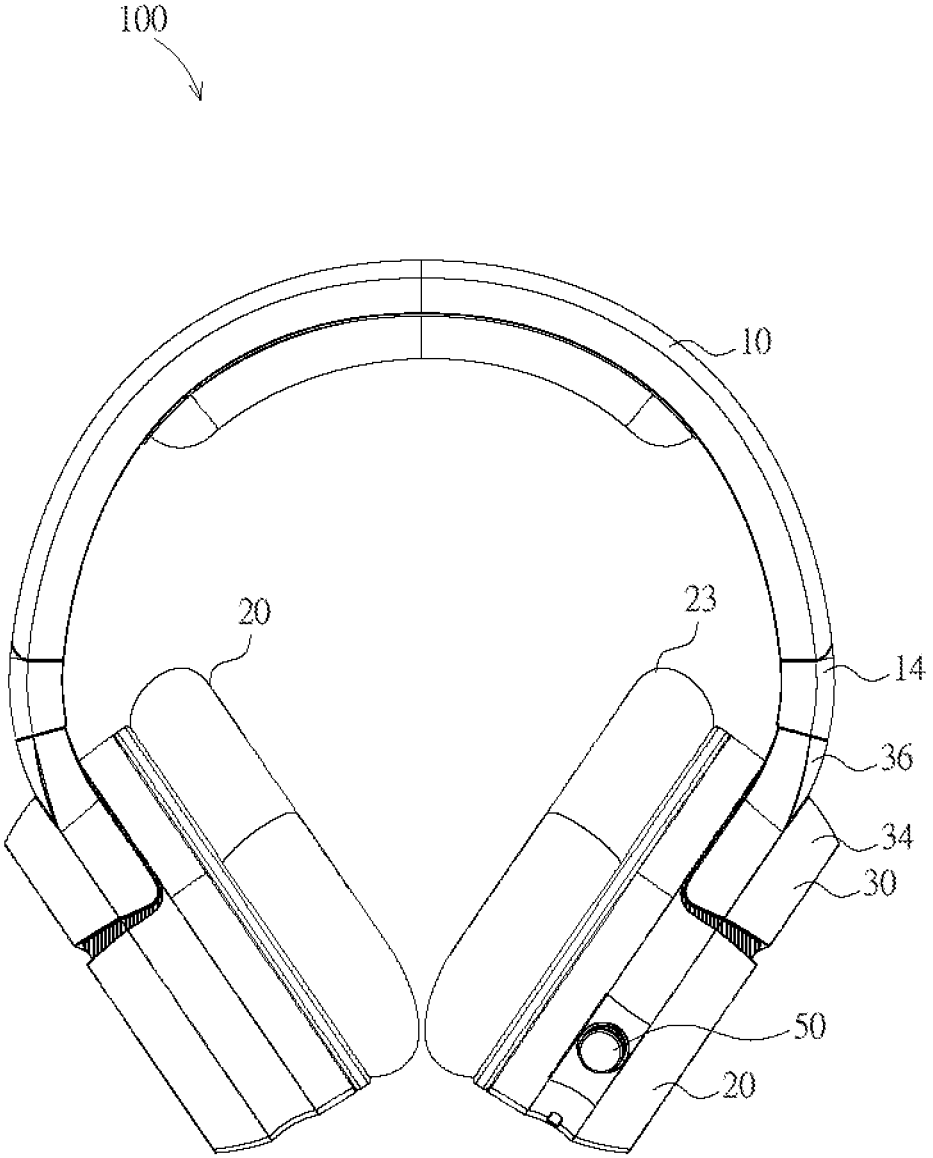
FIG. 4 is a schematic front view showing the headphone according to the embodiment of the invention.
Figure 5:
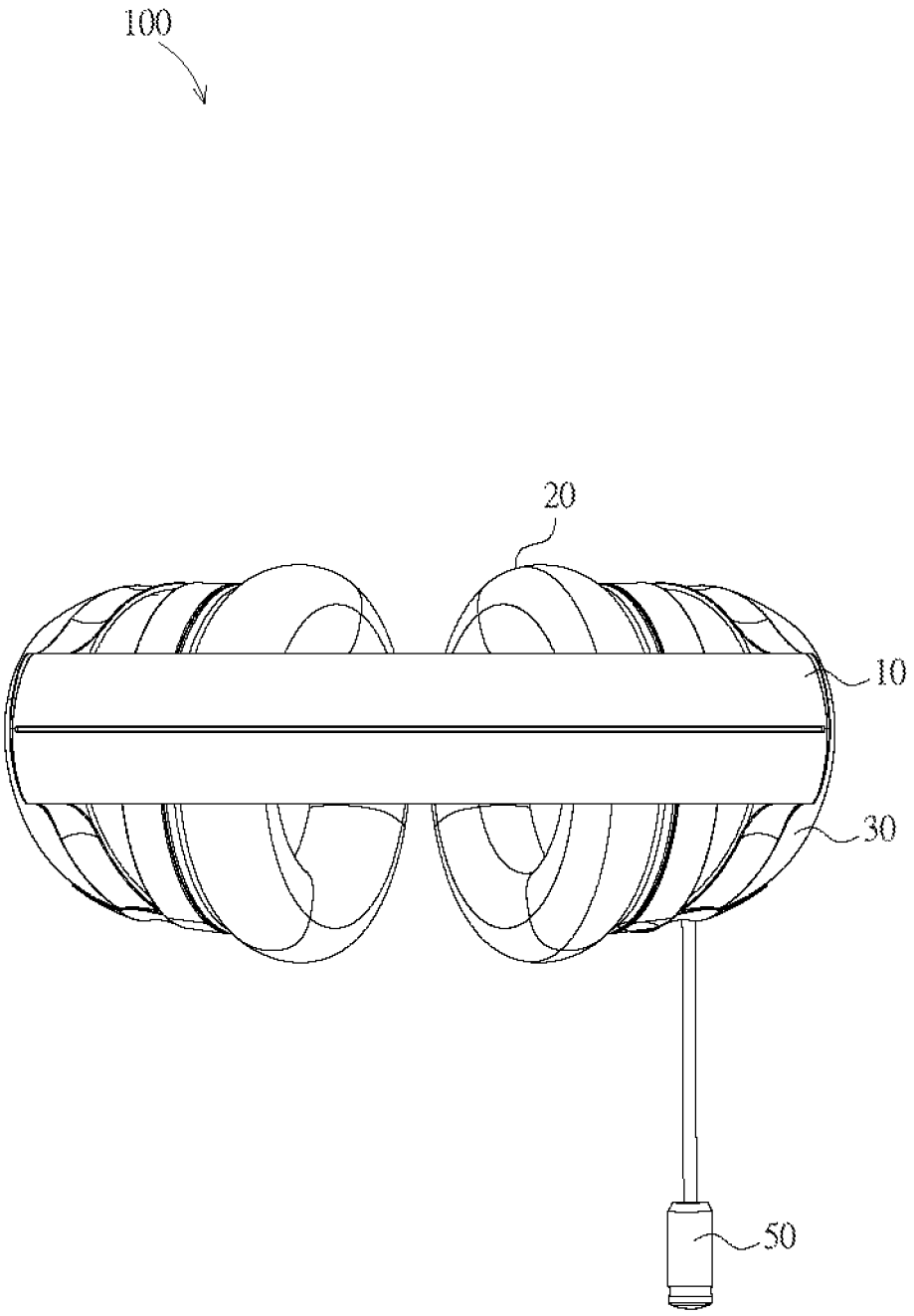
FIG. 5 is a schematic top view showing the headphone according to the embodiment of the invention.

As shown in FIG. 7, please compare with FIG. 3, the earmuffs 20 of FIG. 7 rotates outward so that the angle between the light cover 30 and the translucent housing 40 is less than 180 degrees, and angle between the original light cover and the translucent housing 40 is substantially a plane of 180 degrees. The light shielding cover 30 is relatively rotated downward relative to the angle of the earmuffs 20. The light cover 30 and the translucent housing 40 further constitute a second light-transmitting window 42 exposed to the upper portion of the translucent housing 40, and the rotation of the light cover 30 relative to the translucent housing 40 changes the area and size of the second light-transmitting window 42. The larger the angle at which the light cover 30 is rotated downward relative to the earmuffs 20 is, the larger the area and the higher the shape height of the second light-transmitting window 42 is.

Figure 2:
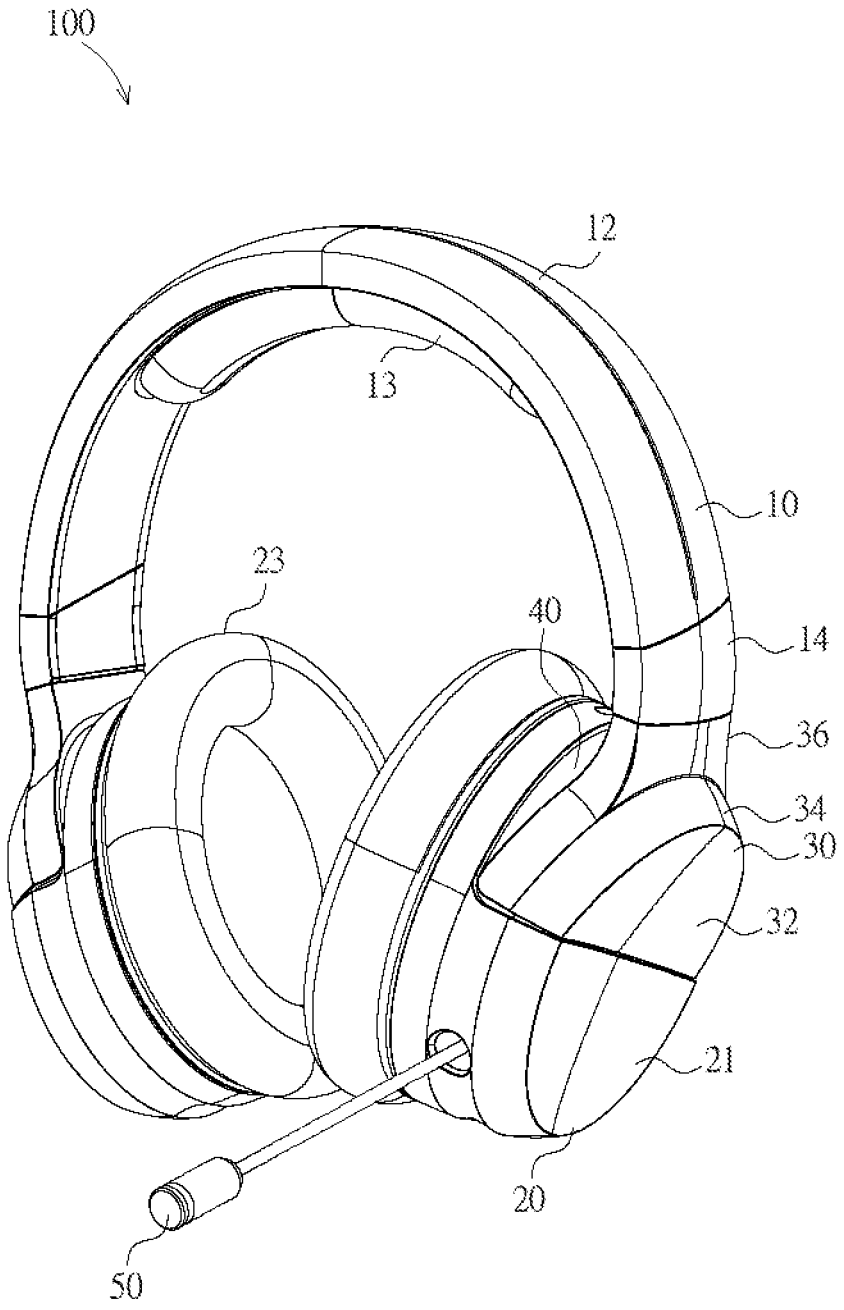
FIG. 2 is a schematic external view showing the headphone according to the embodiment of the invention.

When the angle between the light cover 30 and the translucent housing 40 is generally the 180-degree plane in FIG. 2 and FIG. 3, the first light-transmitting window 41 and the second light-transmitting window 42 exposed by the light cover 30 are both thin light-emitting strips. The first light-transmitting window 41 and the second light-transmitting window 42 are located on opposite sides of the light cover 30. That is, when the first light-transmitting window 41 is smaller, the second light-transmitting window 42 is larger; conversely, when the first light-transmitting window 41 is larger, the second light-transmitting window 42 is smaller. In other embodiments of the invention, the light shielding cover 30 may also partially cover the outer side strip 83 of the main housing 21 and/or the outer side of the semi-circular side plate 84 (not shown in the figure).

When using the headphone 100, for example, by pressing a button on the headphone 100, rotating the light cover 30 as an instruction or auxiliary software of computer operation, the control board 22 controls the light-emitting components 24 to generate a light conversion effect and convey the vision message to someone other than the wearer.

The connection between the light cover 30 and the translucent housing 40 exhibits a variety of physical changes according to the clamping angle, resulting in different light effects, making the headphone 100 of the invention provide a variety of light effects and beautiful visual experience.

As mentioned above, the headphone of the present invention has the following advantages. First of all, the headphone has a variety of shapes. The shape and color of the decorative piece, the first light-transmitting window and the second light-transmitting window can be changed according to the needs of the user. Therefore, the user can match a variety of different colors and shapes. Moreover, since the rotation of the light relative to the translucent housing 40 changes the area of the light-emitting window of the light-transmitting casing. The connection between the earmuffs and the light-shielding cover will provide a variety of light effects according to the different clamping angles, providing a varied and gorgeous visual experience.

In addition, because the translucent housing is located in a prominent position on the outside of the headphone, the headphone can provide a visual reminder function to convey visual information or alert function to people other than the wearer. In the process of using, the light conversion effect generated by the combination of the control board and the light-emitting components can inform the people other than the wearer of the operation of the invention and achieve the eye-catching effect. In addition, since the two earmuffs are first pivoted to the light cover and then connected to the headgear through the light cover, the headphone of the present invention can provide two different adjustment positions and two different angle plane rotation directions, so the users may use the headphone according to the position where they feel comfortable.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

What is claimed is:

1. A headphone, comprising:

a headgear;

at least one earmuff, which has a translucent housing;

a light-emitting component, which is disposed in the earmuff corresponding to the translucent housing; and a light cover, which is movably covered outside the earmuff and has a first connecting member and a second connecting member, wherein the first connecting member is pivotally connected to the headgear, and the second connecting member is pivotally connected to the earmuff, and comprising:

a semi-circular lateral plate;

an arc side strip, which is extended from the circumference of the semi-circular lateral plate; and a bridge part, which is extended from the arc side strip and has the first connecting member of the light cover, wherein the bridge part is pivotally connected to the headgear.

2. The headphone of claim 1, wherein the headgear comprises a first insertion pin, and the first connecting member of the light cover is a first hole, and the first insertion pin is inserted into the first hole to pivot the light cover with the headgear.

3. The headphone of claim 1, wherein the second connecting member of the light cover is a second insertion pin, and the earmuff includes a second hole, and the second insertion pin is inserted into the second hole to pivot the light cover to the earmuff. In addition, the second hole may be disposed on the translucent housing of the earmuff.

4. The headphone of claim 3, wherein the second hole is located on the translucent housing of the earmuff.

5. The headphone of claim 1, wherein the shape of the translucent housing essentially corresponds to the shape of the semi-circular lateral plates and the arc side strips of the light cover.

6. The headphone of claim 1, wherein the second connecting member of the light cover is located at one end of the arc side strip and is located inside the light cover.

7. The headphone of claim 1, further comprises a control board, which is disposed in the earmuff for adjusting the light color, blinking rate, and/or lightness of the light-emitting component.

8. The headphone of claim 1, wherein the light cover and the translucent housing consist of a first light-transmitting window and the rotation of the light cover relative to the translucent housing changes the area of the first light-transmitting window.

9. The headphone of claim 1, wherein the light cover and the translucent housing consist of a first light-transmitting window and a second light-transmitting window.

10. The headphone of claim 9, wherein the first light-transmitting window and the second light-transmitting window are located on opposite sides of the light cover, and the rotation of the light cover relative to the translucent housing causes a negative correlation change between the area of the first light-transmitting window and the second light-transmitting window.

* * * * *